United States Patent [19]

Ziv et al.

[11] 4,287,398

[45] Sep. 1, 1981

[54] INERTIA SWITCHES

[75] Inventors: Avraham Ziv, Sepulveda; Akira Tanaka, Northridge; William Hollowell, Pacific Palisades; William J. Sieber, Northridge; Munir J. Ahad, Newhall, all of Calif.

[73] Assignee: American Safety Equipment Corporation, San Fernando, Calif.

[21] Appl. No.: 61,695

[22] Filed: Jul. 30, 1979

[51] Int. Cl.[3] ..... H01H 35/14

[52] U.S. Cl. ..... 200/61.45 R; 200/61.5

[58] Field of Search ..... 200/61.45 R, 61.45 M, 200/61.48, 61.49, 61.5, 61.51, 61.52

[56] References Cited

U.S. PATENT DOCUMENTS

| | | | |
|---|---|---|---|
| 1,868,365 | 7/1932 | Paul | 200/61.5 |
| 2,176,770 | 10/1939 | Maught | 200/61.5 |
| 2,206,067 | 7/1940 | Waltamath | 200/61.45 R |
| 2,236,872 | 4/1941 | Grigsby | 200/61.5 |
| 2,313,549 | 3/1943 | Hornian | 200/61.48 |
| 2,360,561 | 10/1944 | Halderson | 200/61.5 |
| 2,406,427 | 8/1946 | Leonard | 200/61.5 |
| 2,539,736 | 1/1951 | Fraser | 200/61.5 |
| 2,879,349 | 3/1959 | Thompson | 200/61.5 |
| 2,903,533 | 9/1959 | Weaver | 200/61.5 |
| 2,952,752 | 9/1960 | Weaver | 200/61.45 R |
| 2,966,562 | 12/1960 | McElvain | 200/61.5 |
| 3,066,202 | 11/1962 | Kaleba et al. | 200/61.5 |
| 3,175,059 | 3/1965 | Chestnut | 200/61.52 |
| 3,436,499 | 4/1969 | Butts | 200/61.48 |
| 3,471,661 | 10/1969 | Miller | 200/61.5 |
| 3,518,385 | 6/1970 | Boudes et al. | 200/61.45 |

*Primary Examiner*—James R. Scott

*Attorney, Agent, or Firm*—Poms, Smith, Lande & Rose

[57] ABSTRACT

An inertia switch resettably breaks an electrical contact upon a change in the momentum of the switch body above a predetermined level or upon inversion of the switch body. An inertia sensing pendulum detects momentum changes upon the switch body and upwardly moves an actuator shaft upon a momentum change above a level determined by a biasing mechanism. The actuator shaft is coupled to an electric contact mechanism, which resettably interrupts an electrical connection upon the upward movement of the actuator shaft. A moveable mass in a cylindrical cavity is coupled to the contact mechanism and causes the electrical connection to be broken in response to an inversion of the body. A reset mechanism coupled to the contact mechanism, reestablishes the interrupted electrical connection when manual force is applied to the reset means.

24 Claims, 10 Drawing Figures

Fig. 7.
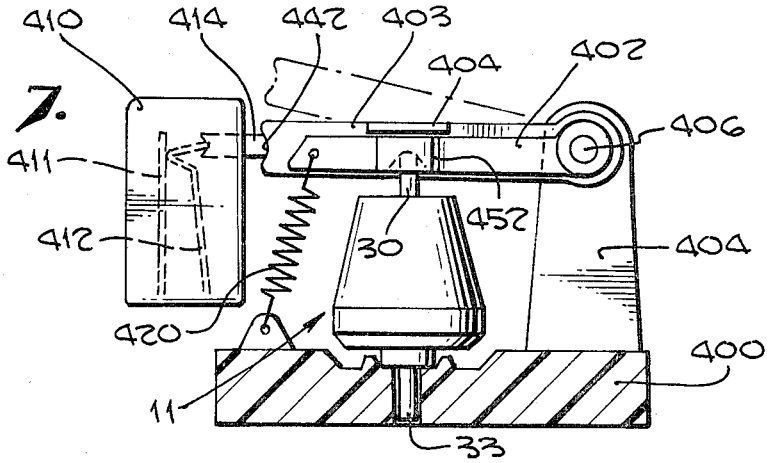
Fig. 9.
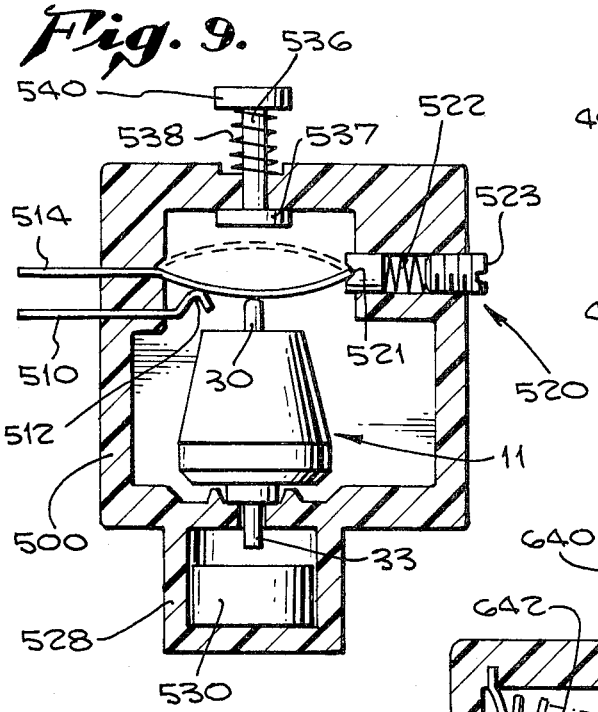
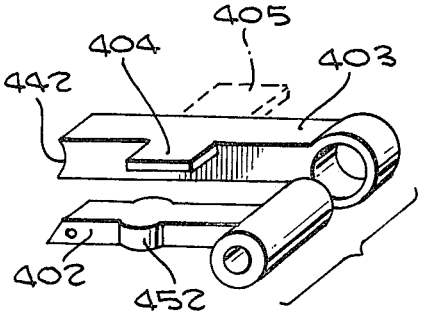
Fig. 8.
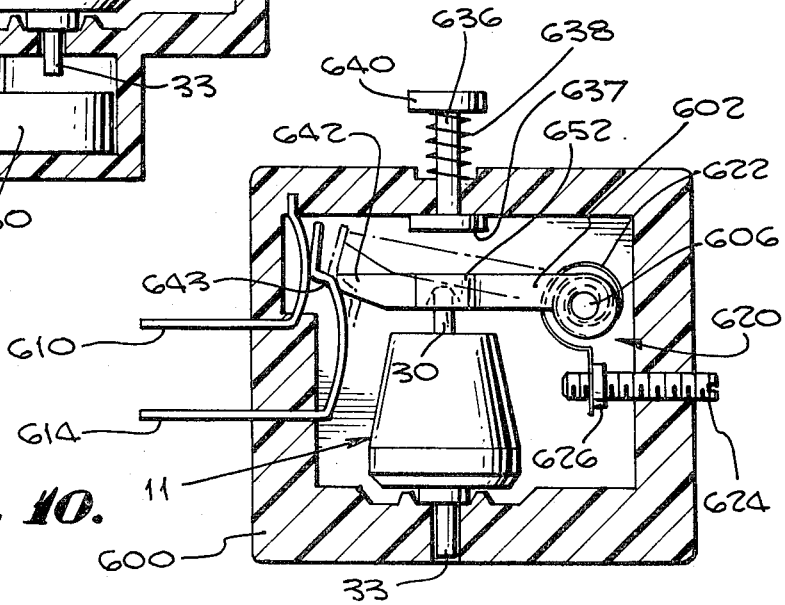
Fig. 10.

INERTIA SWITCHES

FIELD OF THE INVENTION

The present invention relates to electric switches, and in particular to switches responsive to momentum changes upon or inversion of the switch.

BACKGROUND OF THE INVENTION

The severe injuries which typically result from serious vehicle accidents are not always caused by the primary impact of the vehicle. Often, these injuries result from the secondary impact between the vehicle occupants and the vehicle interior after the primary impact has occurred. Additionally, these injuries often occur from fires resulting from the ignition of fuel by the ignition system. The fire danger is particularly acute when the accident results in the inversion of the vehicle.

The injuries due to the secondary impact can often be minimized through the use of seat belts. However, seat belts in vehicles are often not worn by the vehicle occupants because they can be somewhat uncomfortable and restrict movement in the vehicle. Accordingly, much effort has gone into the development of retractor mechanisms responsive to changes in the inertia of the vehicle. Such systems allow the seat belts to slacken until an emergency situation occurs, whereupon the seat belt system activates and restrains the movement of the vehicle occupants. Continuing development of seat belt retractor mechanisms has often utilized electrical devices to automatically activate the seat belt system in an emergency situation.

The injuries resulting from the fires occurring from the ignition of fuel by the ignition system can often be prevented if the electricity supplied to the ignition system is interrupted or if the supply of fuel is inhibited immediately after an accident. Consequently, devices have been developed which either interrupt the current supplied from the battery to the ignition system, or interrupt the fuel supplied from the fuel tank to the engine upon the occurence of an emergency situation.

The key element in electrically-activated seat belt systems and in those devices interrupting the ignition circuit or the fuel line is a switch responsive to changes in the inertia of the vehicle. Some of the switches found in the prior art generally utilize ball-shaped masses held upon conical seats by magnets. A change in the acceleration of the vehicle results in the unseating of the ball and the opening of an electrical contact. Other devices found in the prior art utilize mercury switches which break an electrical circuit upon a sufficient inertia change in the vehicle.

Generally, all of these devices are somewhat complicated mechanically and are not constructed to allow sufficient control over the device sensitivity to prevent activation of the switch when the vehicle encounters rough road or other normal shock. Those devices which have incorporated a sensitivity adjustment are not sufficiently sensitive to activate the switch upon certain shocks which result from loss of control of the vehicle, such as the overrunning of a curb. Additionally, many of the devices found in the prior art do not incorporate mechanisms for resetting the switch after activation of the switch has occurred. In those switches which have incorporated such mechanisms, the resetting mechanism is not designed for convenient use by the vehicle occupant.

Most importantly, the inertia switches found in the prior art are primarily sensitive to changes in the acceleration of the vehicle, and are not sensitive to inversion of the vehicle. As the danger from fire is greatest when the vehicle is inverted, the provision of a mechanism to insure activation of an inertia switch upon such inversion would greatly enhance the effectivity of an inertia switch. An inertia switch responsive both to momentum changes and to inversion would have wide-ranging application in a variety of vehicles. Such a device would greatly increase the safety of the vehicle occupants, and thus help to minimize the serious injuries which often occur in vehicle accidents.

Accordingly, it is the principal object of this invention to provide an inertia switch mechanism responsive to both a change in the momentum and an inversion of a vehicle in which the switch is installed.

It is an additional object of this invention to allow adjustability in the level of the momentum change necessary to cause activation of the switch.

It is still another object of this invention to simplify the design of inertia switches.

It is still another object of this invention to incorporate a convenient reset mechanism in an inertia switch.

It is a final object of this invention to minimize the danger to vehicle occupants resulting from secondary impact within the vehicle interior and from fires resulting from the ignition of fuel by the ignition system.

SUMMARY OF THE INVENTION

The present invention, in a broad aspect, provides an inertia switch incorporating an electric contact mechanism utilizing resilient electric contacts coupled to an inertia sensing pendulum mechanism. The inertia sensing pendulum detects momentum changes upon the switch body above a predetermined level. The contact mechanism which is coupled to the pendulum via an actuator shaft from the pendulum, resetably interrupts an electrical connection established by the electric contacts upon upward movement of the actuator shaft.

In accordance with one feature of the invention, the level of momentum change above which the actuator shaft interrupts the electrical connection is determined by a spring biasing mechanism connected to the electric contacts. A reset mechanism is also provided to reestablish the interrupted electrical connection.

In accordance with another feature of the invention, the inertia switch can include a moveable mass positioned in a cylindrical cavity coupled to the electric switch. Contact between the mass and the electrical contact mechanism, upon inversion of the switch, interrupts the electrical connection provided by the contacts. Accordingly, the electrical connection is selectively interrupted whenever the determined level of momentum is exceeded or when the switch is inverted.

In accordance with another feature of the invention, the reset mechanism includes a plunger slidably mounted to the body for movement between a first position and a second position, with the second position resetting the electric contacts, and thereby reestablishing the electrical connection. The plunger is biased to the first position until manual pressure is applied to the plunger, whereupon the plunger moves to the second position.

In accordance with a first embodiment of the invention, the electric contact mechanism includes a lever journaled to the body for rotative movement between a first and second position, with the spring bias urging the lever toward the first position until occurrence of the upward movement of the actuator shaft or contact with the mass, whereupon the lever moves to the second position. The electric contacts establish the electrical connection when the lever is in the first position and interrupt the electrical connection when the lever is in the second position. A pair of control arms on one of the resilient contacts operatively engage the lever and the reset mechanism. The control arms position the electric contacts to establish the electrical connection when the lever is in the first position and to interrupt the connection when the lever is in the second position. The control arms also maintain the lever in the second position until the reset mechanism reestablishes the connection.

In accordance with still another feature of the invention, the resilient electric contacts are elongated members of electrically conductive material passing through the switch body and having free ends disposed interiorly within the body to define a pair of spaced contacts. The resilience of the members position them apart when the lever is in the second position. The control arms diverge outwardly from one of the electrically conductive members, with one of the control arms abuttingly engaging the lever to cause contact between the conducting members when the lever is in the first position and to maintain the lever in the second position upon occurrence of the upward movement of the actuating shaft or upon contact with the mass. The other control arm operatively engages the reset mechanism, upon manual activation thereof, to move the first and second control arms to a position allowing the lever to return to the first position, whereupon the electric connection is reestablished between the electrically conductive members.

In the first embodiment, the spring bias mechanism comprises a spring, connected between the body and the lever, which biases the lever against upward movement of the shaft. The biasing is small in comparison to the force on the lever provided by the mass when the body is inverted. Accordingly, the lever is rapidly positioned to the second position whenever the body is inverted.

In accordance with a second embodiment of the invention, the spring bias mechanism can include an adjusting platform between the spring member and the body to allow adjustment of the tension provided by the spring member upon the lever, and thus adjustment of the level of momentum necessary to activate the switch. The adjusting platform is connected to a threaded adjusting element, which is accessible from the exterior of the switch body to move the platform to provide the necessary tension.

In accordance with a third embodiment of the invention, the cylindrical chamber supporting the moveable mass can be angularly disposed beneath the pendulum mechanism and the electric contact mechanism can include an auxiliary lever disposed adjacent to the cavity and journaled for rotative movement toward the actuating shaft upon contact with the mass. An actuating rod located between the two levers transfers movement of the auxiliary lever, upon contact with the mass, to the primary lever. In this manner, a mechanical advantage is provided allowing a smaller mass to be utilized with the switch.

In accordance with a fourth embodiment of the invention, the electric contact mechanism can comprise an integrated switch having a switch element depressably movable from a position breaking the electrical connection to a position establishing an electrical connection. A lever journaled to the body depresses the switching element to the position establishing the connection until the occurrence of the upward movement of the actuator shaft or until contact with the mass, whereupon the lever moves upwardly and allows the switching element to move outwardly to the position breaking the electrical connection. The lever remains in this position until the reset mechanism is activated.

In accordance with a fifth embodiment of the invention, the electric contact mechanism can include a first curved resilient member of electrically conductive material disposed above the actuator shaft and biased by the biasing spring to snap between an upward curvilinear disposition and a downward curvilinear disposition. When in the downward disposition, the curved resilient member contacts a second member of electrically conductive material and establishes an electrical connection therebetween. The upward movement of the actuator shaft causes the curved member to snap to and remain in the upward curvilinear disposition until returned to the downward disposition by the reset mechanism. In this embodiment, the biasing spring mechanism, which adjusts the curvature of the curved member, includes an adjusting screw urging the spring member against a piston contacting the free end of the curved member disposed interiorly within the body. Also, in this embodiment, the mass is disposed beneath the pendulum mechanism and directly urges the actuator shaft upwardly through the provision of an extended bottom portion of the actuator shaft.

In accordance with a sixth embodiment of the invention, the electric contact mechanism can include two curved members of electrically conductive material adjacently disposed with the second member having a bias away from the first member. A lever in the mechanism urges the conductive members together until the upward movement of the shaft occurs, whereupon the conducting members move apart and maintain the lever in a position preventing the lever from urging the conducting members together. The biasing spring mechanism in this embodiment includes a coiled spring adjustably connected between the lever and the switch body.

Other objects, features, and advantages of the present invention will become apparent from a consideration of the following detailed description and from the accompanying drawings.

BRIEF DESCRIPTION OF THE DRAWINGS

FIG. 7 is a cross-sectional view of a fourth embodiment of an inertia switch according to the present invention;

FIG. 8 is an exploded view of a portion of the inertia switch shown in FIG. 7;

FIG. 9 is a cross-sectional view of a fifth embodiment of an inertia switch according to the present invention; and FIG. 10 is a cross-sectional view of a sixth embodiment of an inertia switch according to the present invention.

DETAILED DESCRIPTION

Referring more particularly to the drawings, FIGS. 1–10 show six alternative embodiments of an inertia switch implementing the principles of the present invention. Generally, each inertia switch includes a switch body, an inertia sensing pendulum, an electric contact mechanism and a reset mechanism. The inertia sensing pendulum detects momentum changes on the switch body above a predetermined level determined by a biasing mechanism. The electric contact mechanism, which is coupled to the pendulum, resettably interrupts an electrical contact when the momentum change above the predetermined level occurs. The reset mechanism is used to manually reestablish the broken electrical contact.

Figure 1:
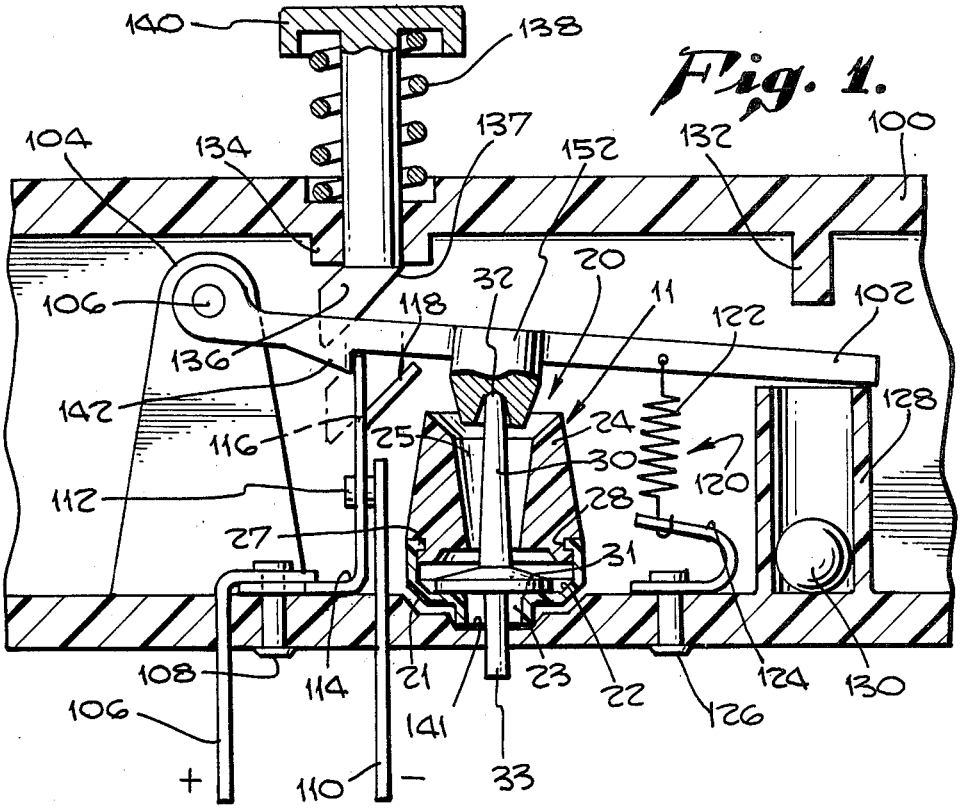
FIG. 1 is a cross-sectional view of a first embodiment of an inertia switch according to the present invention.

The inertia sensing pendulum mechanism is common to all of the embodiments, and is identical to that disclosed in U.S. Pat. No. 4,018,400, and the description of it therein is incorporated by reference herein. Referring to FIG. 1, which shows the first embodiment of the invention, the inertia sensing pendulum, denoted 11, generally includes a pendulum body 20 and a lightweight base 21 of cup-like configuration having an interiorly-formed primary actuator camming surface 29 and an interiorly-formed secondary actuator camming surface 22. A hollow cylindrical inertia sensing mass 24, which is of a material relatively heavier than that of the base 21, is fitted to the base 21 by means of an interlocking snap-fit between an interior annular rib 27 within an upper portion of the base and an exterior annular channel 28 on a lower portion of the inertia sensing mass 24. A vertical axial bore is formed within the inertia sensing pendulum by a central cavity 25 of the inertia sensing mass 24 and by an aperture 23 on the switch body 100, which is generally disposed in the attitude illustrated.

An actuator shaft 30 is disposed within the axial bore of the pendulum body and is provided with a thrust flange 31 located between the upper and lower ends of the actuator shaft 30. The thrust flange 31 is continuous in the axial bore of the pendulum body and rests upon the actuator camming surface 29 in a force-transmitting relationship. An upper end or tip 32 of the actuator shaft 30 extends outwardly beyond the top of the mass 24. The inertia sensing pendulum 20 and the enclosed actuator shaft 30 are positioned by a recess 141 on the switch body 100 such that the inertia sensing pendulum 20 and the actuator shaft 30 are supported in a vertical disposition. Upon movement of the inertia sensing pendulum 20, the actuator shaft 30 is moved in an upward direction by the engagement between the thrust flange 31 and the actuator camming surfaces 29 and 22.

The supporting recess 141 is provided with a first central aperture 23 extending through the switch body 100, and the actuator shaft 30 is provided with an extended portion 33 at its lower end. The extended portion 33 extends through the central aperture 23, thereby aligning the actuator shaft 30 within the axial bore of the inertia sensing pendulum 20 on the switch body 100.

When the inertia sensing pendulum 20 is supported in the described attitude, the thrust flange 31 of the actuator shaft 30 lies upon the primary actuator camming surface 29 of the pendulum base 21. As the sensing means 24 is initially displaced from a generally perpendicular attitude, as would occur during abnormal or emergency vehicle operation, a portion of the primary actuator camming surface 29 of the pendulum base 21 is forced upwardly against the peripheral portion of the thrust flange 31, thereby causing the actuator shaft 30 to be moved vertically. The actuator shaft 30 acts as pendulum body mass stop which limits the ultimate displacement of the pendulum body by means of an abuttable contact with the interior surface 26 of the mass 24.

Accordingly, when the proper change in momentum occurs, the actuator shaft 30 moves upwardly and breaks an electrical connection established by the electric contact mechanism in the switch. The upward movement of the actuator shaft 30 is limited by a biasing mechanism. The configurations of the electric contact and biasing mechanisms vary among the different embodiments, and each is described separately for each embodiment.

Figure 2:
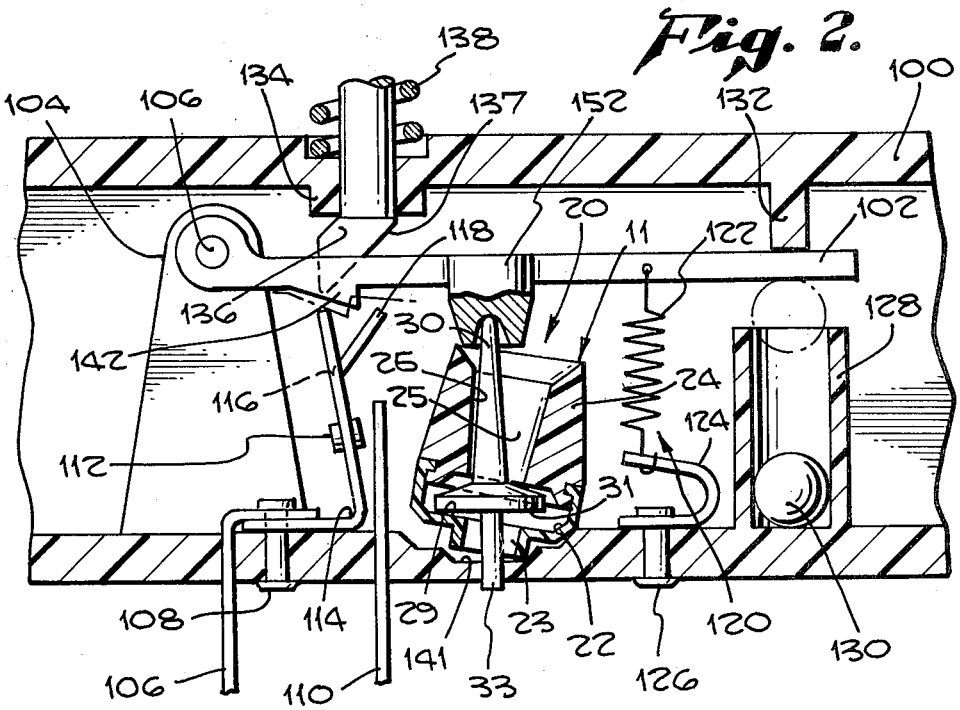
FIG. 2 is a view of the inertia switch of FIG. 1 with the parts in an alternate position.

As mentioned, the first embodiment of an inertia switch according to the present invention is shown in cross section in FIGS. 1 and 2. In this embodiment, the electric contact mechanism includes a lever and a pair of resilient electric contacts, and the spring bias mechanism includes a coiled spring.

Regarding the contact mechanism of the embodiment shown in FIG. 1, a lever 102 is rotatably mounted to a lever support 104 depending upwardly from the body 100 and having a generally triangular shape. The lever 102 is disposed over the actuating shaft 30 portion of the inertia sensing pendulum 11. In this regard, the rounded tip 32 of the actuator shaft is fitted into a socket 152 depending downwardly from the lever 102. This arrangement allows a relative rotation between the socket 152 and the tip 32 of the actuator shaft during upward movement of the actuator shaft 30 in response to a momentum change of the vehicle. The lever 102 is biased downwardly toward the inertia pendulum 11 by the biasing mechanism 120.

The biasing mechanism 120 includes a spring 122 and a spring support 124 mounted by a pin 126 to the body 100. The spring 122 is attached between the lever 102 and the spring support 124. The biasing force of the spring 122 limits the degree to which the actuating shaft 30 may upwardly move the lever 102, and thus defines a specific level of momentum change which must be exceeded before the actuating shaft 30 may move upwardly to a degree to break the electrical connection created by the electric contacts.

The resilient electric contacts are a pair of thin, elongated, resilient members 114 and 110 of electrically conductive material attached to the body 100. Each member has a free end oriented internally within the body 100, thereby defining a pair of spaced contacts. The first of these members 110 is relatively straight and passes through a mounting slot in the body 100 to a first circuit point outside of the body. The second of these members 114 is mounted to the body 100 by a mounting pin or rivet 108, and passes to a second circuit point outside of the body 100 by means of an auxiliary member 106. Contact between the first conductive member 110 and the second conductive member 114 is provided by a contact slug 112 on the second member 114 which abuttingly contacts the first member 110.

As shown in FIG. 2, the resilience of the second conductive member 114 causes it to be biased away from the first conductive member 110. In this manner, the contact slug 112 is disposed away from the first conductive member and electrical continuity between the first conductive member 110 and the second conductive member 114 is prohibited.

The upper end of the second conducting member 114 is split to form two control arms 116 and 118. The first control arm 116 extends upwardly from the remainder of the member 114. The second control arm 118 diverges outwardly from the second conducting member 114 away from the first control arm 116. The first control arm 116 engages a detent surface 142 extending downwardly from the lever 102. As shown in FIG. 1, the detent surface 142 abuttingly engages the first control arm 116 prior to any upward movement of the actuating shaft 30. The abutting engagement of the first control arm 116 with the detent 142 overcomes the resiliency of the second conducting member 114 and, accordingly, urges the second conducting member 114 toward the first conducting member 110 in a manner whereby the contact slug 112 contacts the first conducting member 110. Thus, an electrical connection is established between the first conducting member 110 and the second conducting member 114.

The lever 102 remains in the position shown in FIG. 1 until the switch body 100 undergoes a momentum change to a degree whereby the actuating shaft 30 overcomes the biasing force provided by the spring 122. When this occurs, the lever 152 rotates against the biasing force provided by the spring 122 from the position shown in FIG. 1 to the position shown in FIG. 2. When the lever 152 has moved from the first position shown in FIG. 1 to the second position shown in FIG. 2, the first control arm 116 loses contact with the detent surface 142 and the resilience of the second conducting member 114 urges the second conducting member 114 away from the first conducting member 110. Consequently, the contact slug 112 no longer abuts the first conducting member 110 and electrical connection between the first and second conducting members 110 and 114 is broken. A lever stop 132 depending downwardly from the switch body 100 limits the upward rotation of the lever 152 upon the upward movement of the actuator shaft 30.

The movement of the second conducting member 114 away from the first conducting member 110, upon the disengagement of the first control arm 116 with the detent surface 142, positions the first control arm 116 somewhat behind the detent surface 142. As shown in FIG. 2, this positioning causes the lever 102 to remain positioned against the lever stop 132 by virtue of the fact that the first control arm prevents the downward movement of the lever 102 after disengagement with the detent surface 142 has occurred.

The inertia switch shown in FIGS. 1 and 2 also incorporates a provision for causing disengagement between the detent surface 142 and the first control arm 116 upon the inversion of the switch body 100. In this regard, adjacent the end of the lever 102 farthest from the lever support 104 is provided a generally cylindrical and hollow member 128 depending upwardly from the switch body 100. In the cylindrical member 128 is positioned a moveable mass 130.

Upon the inversion of the switch body 100, the mass 130 travels in the cylindrical member 128 towards the lever 102. As the weight of the mass 130 is chosen to be greater than the biasing force provided by the spring 122, any contact between the mass 130 and the end of the lever 102 will cause the lever to quickly move upwardly from its first position, as shown in FIG. 1, to its second position, as shown in FIG. 2. This upward rotative movement of the lever 102 also causes disengagement of the first control arm 116 from the detent surface 142. As described previously, once the disengagement between the first control arm 116 and the detent surface 142 has occurred, the second conducting member 114 moves away from the first conducting member 110 in a manner positioning the first control arm 116 behind the detent surface 142. This positioning prevents the lever arm 102 from returning to its initial position, as shown in FIG. 1, to allow reestablishment of the electrical connection between the first and second conducting members 110 and 114.

The electrical connection between the first conducting member 110 and the second conducting member 114 is reestablished by the reset mechanism in the switch body 100. As shown in FIGS. 1 and 2, the reset mechanism includes a plunger 136 slidably mounted in an aperture 134 in the housing body 100. The plunger 136 is biased upwardly in the switch body 100 by a spring 138 disposed along the outer periphery of the plunger 136 between the 100 and a handle portion 140 of the plunger. The portion of the plunger 136 within the switch body 100 slants away from the remainder of the plunger 136. This slanting plunger surface 137 is in parallel relation with the second control arm 118. This surface 137 remains biased above the second control arm 118 by the spring 138 until manual pressure is applied to the plunger handle 140, whereupon the slanted plunger surface 137 moves downwardly toward the second control arm 118, as shown in phantom in FIG. 1.

When the plunger surface 137 contacts the second control arm 118, it slides along the plunger surface 37, resulting in its being positioned toward the first contact member 110. As the second control arm 118 and the first control arm 116 are both formed from one free end of the second conducting member 116, the movement of the second control arm 118 also results in the movement of the first control arm 116 toward the first conducting member 110.

The movement of the first control arm 116 along the lever 152 toward the first conducting member 110 results in the lever 152 pivoting slightly upward as the first control arm 116 approaches the detent surface 142. Once the first control arm 116 is slightly past the the detent surface 142, the lever member 152 is pulled back into its first position, as shown in FIG. 1, by the biasing force of the spring 122. Accordingly, when the plunger 136 has been pushed downwardly to its full extent, the detent surface 142 is again immediately adjacent the first control arm 116. When the plunger 136 is thereafter released, and returned by the spring member 138 to its initial position, the resilience of the second conducting member 114 again causes an abutting engagement between the first control arm 116 and the detent surface 142. The lever 152 will remain in this position until recontacted by the mass 130 or until an upward movement of the actuating shaft 30 occurs to an extent overcoming the biasing force provided by the spring 122.

Accordingly, it is seen that a simple and effective inertial switch is provided which is responsive to a sudden change in the momentum of the body 100, or to an inversion of the body 100. The switch thus provides an electrical connection until the momentum change or inversion occurs, whereupon the connection is broken until manually reestablished. Such a switch has many applications, and is especially adapted for use in an automobile or other vehicle, where it is desirable to automatically remove electric power from the vehicle engine whenever a collision occurs. Other possible vehicle applications are the actuation of seat belt mechanisms in a collision or rapid deceleration.

Figure 3:
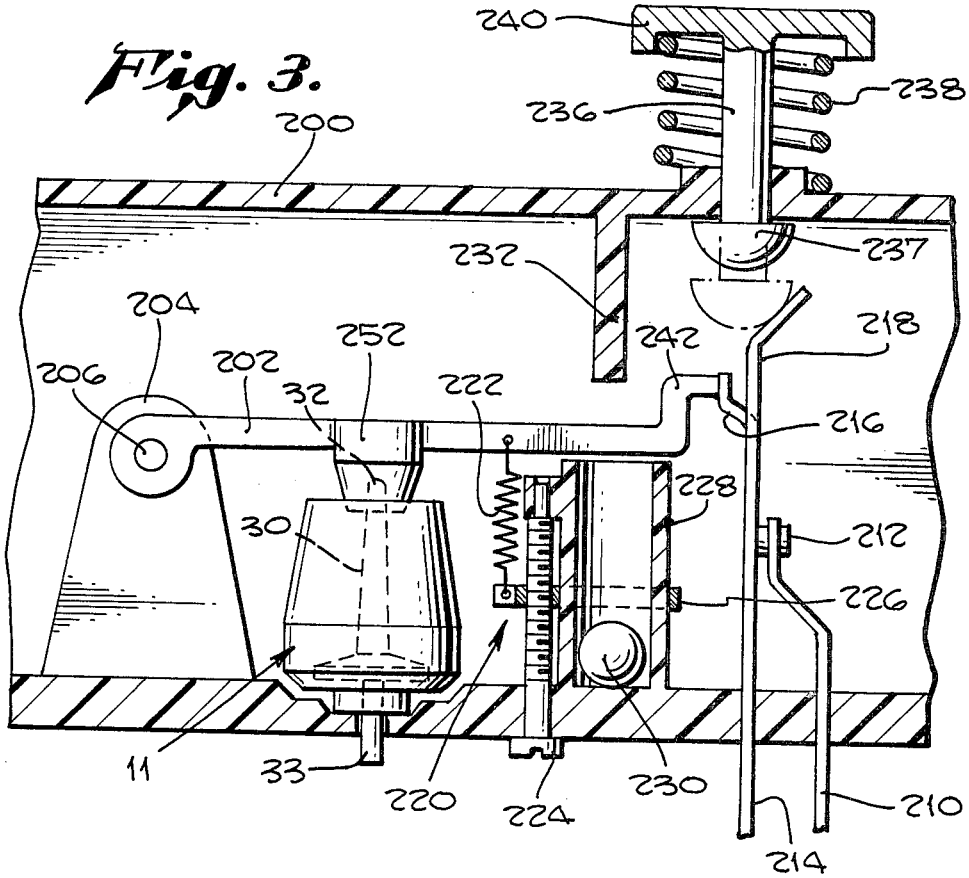
FIG. 3 is a cross-sectional view of a second embodiment of an inertia switch according to the present invention.
Figure 4:
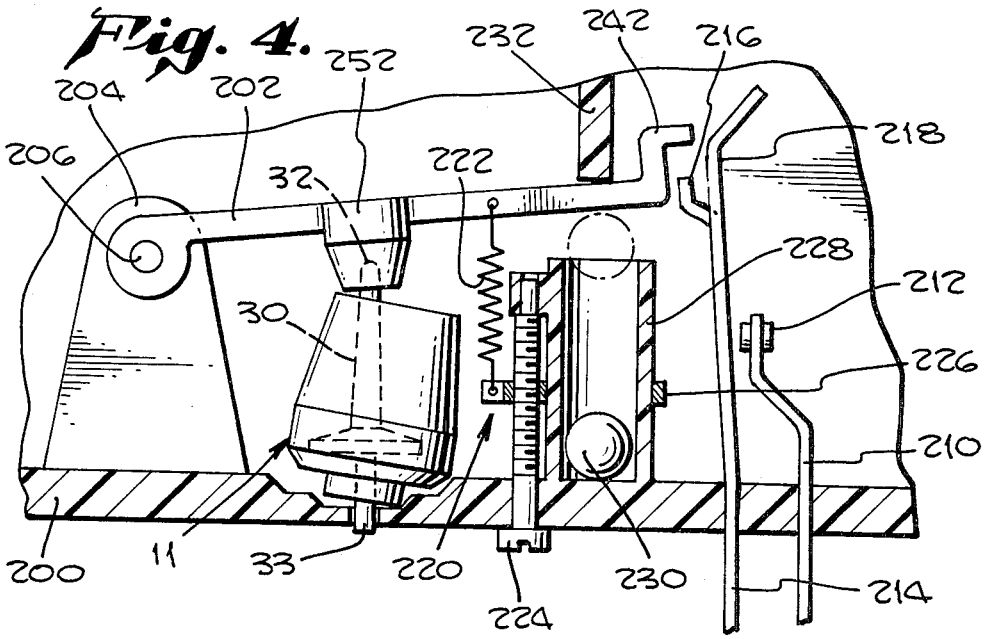
FIG. 4 is a view of the inertia switch shown in FIG. 3 with the parts in an alternate position.

The second embodiment of an inertia switch according to the present invention is shown in cross-section in FIGS. 3 and 4. In this embodiment, the electric contact mechanism again includes a lever and a pair of resilient members of electrically conductive material, and the biasing mechanism includes a coiled spring. In this embodiment, relative to the previous embodiment, positioning of the contact mechanism has been changed and the biased mechanism has been modified to allow adjustment of the tension applied to the lever portion of the contact mechanism.

Regarding the contact mechanism of the second embodiment, a lever 202 is again rotatably mounted by a pin 206 to a lever support 204 depending upwardly from the body 100. The lever 202 is again disposed over the actuating shaft 30 portion of the inertia sensing pendulum 11. The rounded tip 32 of the actuator shaft is positioned in a socket 252 depending downwardly from the lever 202. The lever 202 is biased downwardly toward the inertia pendulum 11 by a biasing means 220. A lever stop 232 again limits the upward movement of the lever 202.

As previously explained, a momentum change of the vehicle in excess of a predefined level causes upward movement of the actuator shaft 30 against the socket 252. The upward movement of the actuator shaft 30 is again limited by a biasing mechanism 220. The biasing mechanism 220 includes a spring 222 mounted to the body 200 in a manner allowing its tension to be adjusted. In this regard, the spring 222 is attached between the lever 252 and an adjusting platform 226 slidably mounted to the outer surface of a cylindrical cavity 228 which contains a moveable mass 230. A threaded adjusting screw 224 passes through the body 200 and engages the adjusting platform 226. Rotation of the adjusting screw 224 causes upward or downward movement of the adjusting platform 226 and varies the tension on the spring 222. This arrangement allows a precise adjustment of the level of momentum change necessary to cause sufficient upward movement of the actuating shaft 30 to break the electrical connection provided by the electric contacts.

The pair of electric contacts are again thin, elongated members 214 and 210 of electrically conductive material attached to the body 200. Each member 214 and 210 has a free end oriented interiorly within the body 200. The first conductive member 210 is angled toward the second conductive member 214, and supports a contact slug 212 by which electrical continuity is established with the second conducting member 214. The second conducting member 214 is relatively straight and, as shown in FIG. 4, has an inherent bias away from the first conducting member 210.

The upper end of the second conducting member 214 is again split to form two control arms 216 and 218. The first control arm 216 diverges from the second conducting member toward the lever 202. In this regard, the upper end of the first control arm 216 is disposed in parallel relation with the end 242 of the lever 202. The end 242 of the lever 202 is generally L-shaped, and abuts the upper end of the first control arm 216 in a manner positioning the control arm 216, and thus the second conducting member 214, toward the first conducting member 210 to establish an electrical connection between the second conducting member 214 and the first conducting member 210. The second control arm 218 diverges away from the first control arm 216 and the lever 202.

As shown in FIGS. 3 and 4, the lever 202 moves between a first position and a second position. The first position, shown in FIG. 3, establishes electrical continuity between the first conducting member 210 and a second conducting member 214. The second position, shown in FIG. 4, breaks electrical connection between the first conducting member 210 and the second conducting member 214. As explained in conjunction with the first embodiment, a sudden change in the momentum of the switch body 200 beyond a level established by the biasing mechanism results in an upward movement of the actuator shaft 30 against the socket 252. Also, an inversion of the switch body 200 causes the mass 230 to contact the lever 202. Either situation results in the lever 202 moving from the first position to the second position, and the electrical continuity between the conducting members correspondingly being interrupted.

The L-shaped end 242 of the lever 202 is prohibited from returning to the first position by the first control arm 216 portion of the second conducting member 214. In this regard, the L-shaped end 242 will remain positioned atop the first control arm 216 until the reset mechanism pushes the second control arm 218 toward the first conducting member 210. This causes the first control arm to be positioned slightly past the lever 202 and, accordingly, allows the lever 202 to be pulled by the biasing mechanism 220 to its initial position shown in FIG. 3.

The reset mechanism in this embodiment again includes of a plunger 236 having a rounded plunger surface 237 and a handle 240. The plunger 236 is slidably mounted within the switch body 200 for movement between a first position and a second position, with the first position placing the rounded plunger surface against the second control arm 218, and with the first position placing the rounded plunger surface 237 against the switch body 200. A spring bias 238 is used between the switch body 200 and the plunger handle 240 to position the rounded plunger surface 237 against the body until manual pressure is applied to the plunger handle 240, whereupon the plunger surface engages the second control arm 218.

The second embodiment of the inertia switch is thus seen to be somewhat more flexible than the first embodiment by the provision of an adjustable biasing mechanism. This feature makes the second embodiment especially suited for any application where a precise control over the allowable amount of momentum on the switch body is desired.

Figure 6:
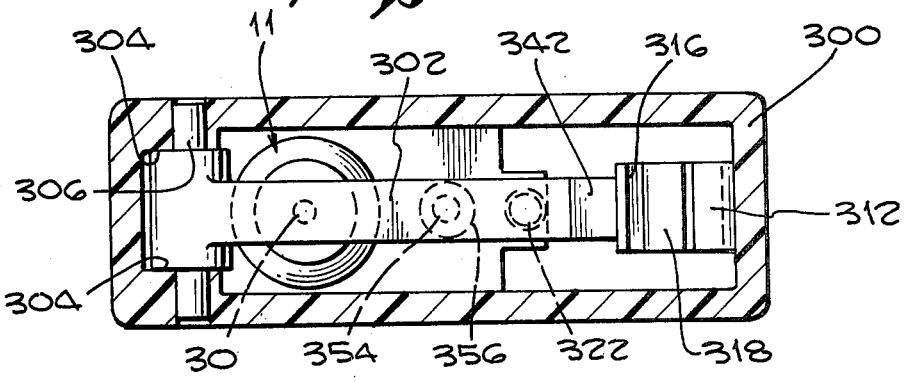
FIG. 6 is a view of the inertia switch shown in FIG. 5, taken through the plane VI—VI.
Figure 5:
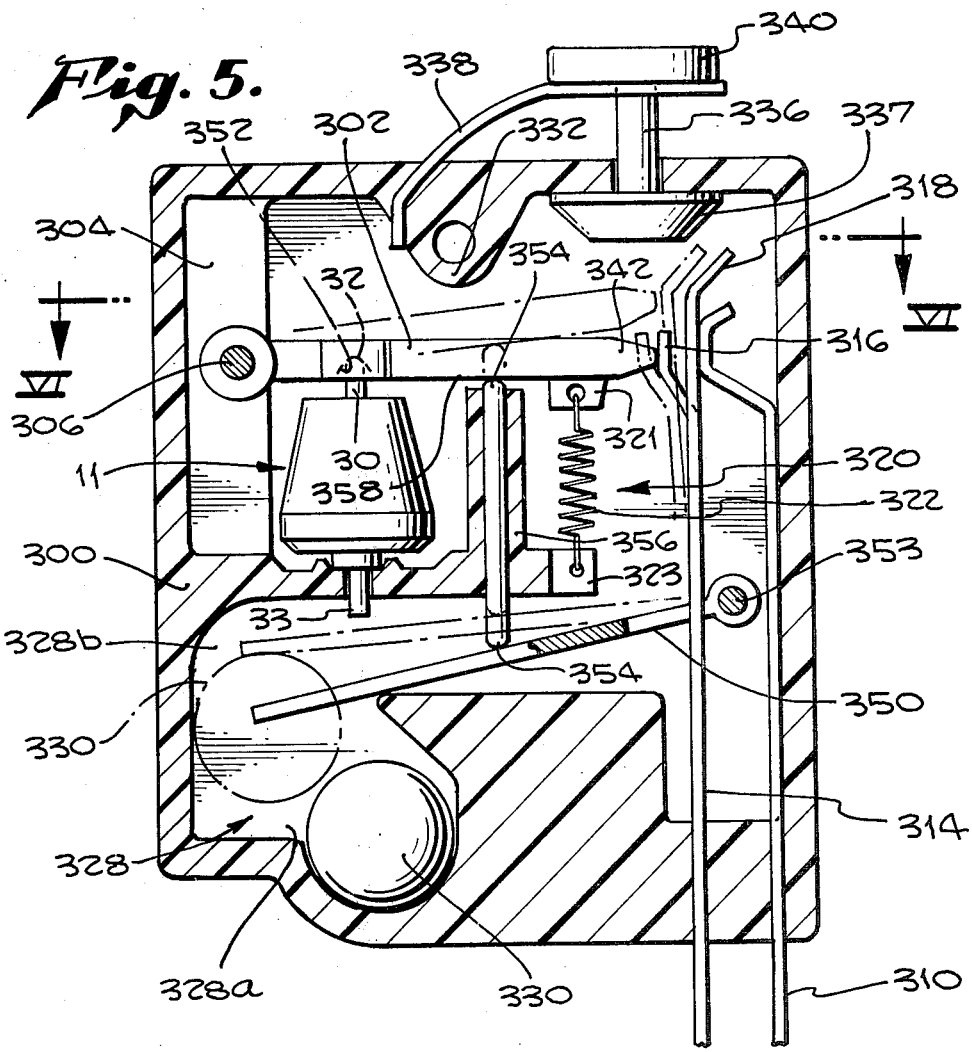
FIG. 5 is a cross-sectional view of a third embodiment of an inertia switch according to the present invention.

The third embodiment of an inertia switch according to the present invention is shown in cross-section in FIGS. 5 and 6. In this embodiment, the electric contact mechanism includes three levers and a pair of electric contacts, and the biasing mechanism again includes a coiled spring.

Regarding the electric contact mechanism of the third embodiment, a primary lever 302 is rotatably mounted by a pin 306 to a lever support 304 formed in the switch body 300 and having a generally rectangular shape. The lever 302 is disposed over the actuating shaft 30 portion of the inertia sensing pendulum 11. The rounded tip 32 of the actuator shaft 30 is again fitted into a socket 352 depending downwardly from the lever 302. The lever 302 is biased downwardly toward the inertia pendulum 11 by the biasing mechanism 320. An integral lever stop 332 limits the upward movement of the lever 302.

The biasing mechanism 320 includes a coil spring 322 mounted between a peripheral flange 321 depending downwardly from the primary lever 302 and a hole in a subframe 323 portion of the switch body 300. The biasing force of the spring 322 limits the degree to which the actuating shaft 30 may upwardly move the lever 302, and thus defines the specific level of momentum change which must be exceeded before the electrical connection created by the contact mechanism is broken.

The electric contacts are again a pair of thin, elongated resilient members 314 and 310 of electrically conductive material attached to the body 300. Each member has a free end oriented interiorly within the body 300. The first of these members 310 is relatively straight and has an angled upper portion 312 forming a contacting surface for the second conducting member 314. The second member 314 has a bias urging it away from the first conducting member 310 when the lever 302 has been moved upwardly, as shown in phantom in FIG. 5.

The second conducting member 314 again has a pair of control arms 316 and 318 formed in its upper end. The first control arm 316 diverges outwardly from the second conducting member 314 towards the lever 302. The first control arm 316 abuttingly engages the end 342 of the lever 302 prior to a sudden change in momentum on the switch body 300, or prior to inversion of the switch body 300. The abutting engagement between the first control arm 316 and the end 342 of the lever 302 urges the second conducting member 314 against the first conducting member 310, and thereby establishes an electrical connection between the conducting members 314 and 310.

Upon upward movement of the lever 302, the second conducting member loses contact with the first conducting member 310, and the primary lever 302 is prevented from returning through its initial position by the first control arm 316. Contact between the conducting members 314 and 310 is reestablished by a reset mechanism similar to that in the previous embodiments. The reset mechanism again includes a reset plunger 336 slidably mounted within the body. The reset plunger 336 includes a frustoconical reset surface 337 disposed above the second control arm 318. A resilient member 338, positioned between the switch body 300 and the handle portion 340 of the reset plunger 336, urges the frustoconical reset surface 347 against the body 300 until manual pressure is applied to the plunger handle 340. Upon such application of manual pressure, the plunger surface 337 engages the second control arm 318, thereby moving the second control arm, and thus the second conducting member 314 toward the first conducting member 310, thereby allowing the primary lever 302 to urge the conducting members together, and establish an electrical connection therebetween.

The primary modification made in the third embodiment relative to the other embodiments is in the inversion mechanism portion of the electric switch. In this regard, a generally cylindrical cavity 328 is formed within the housing body 300. The cylindrical cavity 328 includes a first portion **328*a* and a second portion 328*b*. The first portion 328*a* of the cavity is restrictively configured relative to the second portion 328*b*. Thus, the moveable mass 330 therein moves upwardly in a generally diagonal direction upon inversion of the switch body 300**.

The second portion **328*b* of the cylindrical cavity 328 is adjacent the first portion 328*a* and contains a secondary lever 350. This lever 350 is journaled by a pin 353 to the switch body 300 for rotative movement toward the inertia pendulum 11 upon contact with the mass 330. Disposed centrally above the second lever 350 is an actuating rod 354. The actuating rod 354 is slidably mounted within a cylindrical cavity 356 in the subframe 323 portion of the switch body 300. The actuating rod 354 transfers the upwardly rotative movement of the secondary lever 350 to the primary lever 302. In this regard, the actuating rod 354 contacts the lower surface 358 of the primary lever 302**.

This particular arrangement of the inversion detection mechanism allows a greatly reduced mass 330 to be utilized as the arrangement of the secondary lever 350 and the actuating rod 354 provides a fulcrum arrangement multiplying the mechanical advantage provided by the mass 330. Upon inversion of the switch body 300, the mass 300 moves against the secondary lever 350, and the resulting movement is transferred to the actuating rod 354. The actuating rod 354 urges the primary lever 302 upwardly, thereby causing disengagement between the first control arm 316 and the end 342 of the primary lever 302. This disengagement remains, as explained above, until the reset plunger 336 is downwardly moved to reposition the second control arm 318 to reestablish the electrical connection.

The particular arrangement of the third embodiment allows a somewhat lighter and smaller configuration than the previous embodiments. The components of the third embodiment, as is the case with the components of the other embodiments, with the exception of the mass, the springs and the electrical conductors, may generally be inexpensively fabricated of plastic or similar material.

The fourth embodiment of an inertia switch according to the present invention is shown in FIGS. 7 and 8. FIG. 7 shows a cross-sectional view of the electric contact and biasing mechanism of the inertia switch. The switch body 400 is shown in only partial form on FIG. 7. Also, a reset mechanism is not shown in FIG. 7. It is to be understood, however, that the switch shown in FIG. 7 is completely enclosed by a switch body 400, and that a reset plunger similar to those previously described is also included.

Regarding the electric contact mechanism portion of the fourth embodiment, the mechanism includes a prefabricated electric switch assembly 410 and a pair of levers 402 and 403 journaled by a pin 406 to a lever support 404 attached to the body 400 and having a generally rectangular shape. The prefabricated switch 410 may be of the microminiature variety. The switch 410 internally includes a first switch contact 411 and a second switch contact 412 which are brought into electrical contact by a plunger 414 extending from the side of the switch 410. In operation, when the plunger is depressed by one of the levers 403, the internal contacts 411 and 412 are brought together and electrical continuity therebetween is established. The plunger 414 is biased outwardly so that when no pressure is applied to it, the internal contacts 411 and 412 separate and thereby interrupt the electrical connection therebetween.

As mentioned, the electric contact mechanism incorporates two levers, a primary lever 403 and a secondary lever 402. The primary lever 403 includes a generally concave lever end 442 which engages the switch plunger 414 to establish an electrical connection between the internal contacts 411 and 412. The primary lever 403 includes a first peripheral flange 404 depending outwardly above the secondary lever 402. As the secondary lever 402 is biased toward the inertia pendulum 11 by the biasing mechanism 420, the concave end 442 of the primary lever 403 abuttingly engages the switch plunger 414.

Whenever a sufficient change in the momentum of the switch body 400 occurs to offset the biasing force provided by the spring 420, the actuating shaft 30 moves upwardly in a socket 452 on the secondary lever 403. This upward movement is transferred by the peripheral flange 404 to the primary lever 403 and disengagement between the concave lever end 442 and the switch plunger 414 results. The subsequent outward movement of the switch plunger 414 prevents the primary lever 403 from returning to its initial position. The lever 403 stays in this disengaged orientation until forced downwardly by the reset means, whereupon the switch plunger 414 is again moved inwardly, thereby reestablishing electrical continuity between the internal conductors 411 and 412.

As shown in FIG. 8, the primary lever 403 may include a second outwardly-depending peripheral flange 405. This flange 405 is used in conjunction with a moveable mass and corresponding cylindrical support as shown in the prior embodiments to cause disengagement of the primary lever 403 with the switch plunger 414. The peripheral flange 405 would be positioned immediately above the mass cavity, whereby inversion of the switch body 400 would cause contact to occur between the mass and the peripheral flange 405 thereby resulting in the movement of the second primary lever 403 to the position disengaging the switch plunger 414.

The fifth embodiment of an inertia switch according to the present invention is shown in cross-section in FIG. 9. In this embodiment, the electric contact mechanism solely utilizes a pair of electrical contacts, and the biasing mechanism is integral with the electrical contacts.

Regarding the electric contact mechanism in the embodiment shown in FIG. 9, the mechanism includes a pair of thin, elongated resilient members 510 and 514 of electrically conductive material attached to the body 500. The first of these members 510 is relatively straight and has a curved end 512 by which contact is made with the second conducting member 514. The second conducting member 514 is mounted in the body 500 under tension, which results in the member having a curvilinear orientation in either an upward or a downward direction. The tension placed upon the second conducting member 514 results in it moving from an upward curvilinear disposition to a downward curvilinear disposition by a snapping action. In the downward disposition, contact is made with the curved end 512 of the first conducting member 510. In this manner, electrical continuity is established between the members 510 and 514.

The biasing mechanism 520 of the embodiment shown in FIG. 9 includes a slug 521 slidably mounted within a bore in the switch body 500. One end of the slug 521 engages the free end of the second conducting member 514 disposed interiorly within the switch body 500. The slug 521 is adjacent a coiled spring member 522. The coiled spring member 522 abuts a threaded adjusted screw 523. The adjusting screw 523 is manually rotatable from the exterior of the switch body 500. Rotating the adjusting screw 523 either compresses or relaxes the spring member 522. The biasing force of the spring member is transferred by the slug 521 to the second conducting member 514. Accordingly, the curvature of the second conducting member 514 is controlled by the adjusting screw 523 to establish the level of momentum change on the switch body 500 necessary to cause the second conducting member 514 to snap from a downward curvilinear disposition to an upward curvilinear disposition.

As with the other embodiments, the urging of the second conducting member 514 from a downward to an upward disposition is done by the actuator shaft 30 portion of the inertia sensing pendulum 11. If the momentum change on the switch body 500 is of a level sufficient to overcome the biasing force provided by the spring member 522, the curved portion of the second conducting member will snap to its upward position and interrupt the electrical continuity established with the first conducting member 500.

The upward disposition of the second conducting member 514 will remain until the second conducting member is manually moved by the reset mechanism to its initial downward position. In this regard, the reset mechanism includes a reset plunger 536 having a generally circular plunger surface 537 interiorly within the body and a handle 540 external to the body. A spring 538 biases the plunger surface 537 against the body 500 until manual pressure is applied to the plunger handle 540, whereupon, the plunger surface 537 is moved to contact the second conducting member 514 and return it to its initial disposition.

As with the other embodiments, a provision is incorporated for interrupting the electrical connection between the first conducting member 510 and the second conducting member 514 upon inversion of the switch body 500. In this regard, a generally cylindrical cavity 528 depends downwardly from the housing body 510 beneath the lower end 33 of the actuator shaft 30. The lower end 33 of the actuator shaft 30 extends downwardly beneath the primary portion of the switch body 500 in an aperture provided therethrough. Directly beneath the lower end 33 of the actuator shaft is a moveable mass 530. The mass 530 is chosen such that it exerts a relatively greater force on the actuator shaft than does the spring member 522 Accordingly, upon inversion of the switch body 500, the cylindrical mass 530 causes a rapid upward movement of the actuatory shaft 30 against the second conducting member 514. Consequently, electrical continuity between the first and second conducting members is rapidly interrupted.

The embodiment shown in FIG. 9 offers the advantage of utilizing the fewest number of components of any of the embodiments. Also, the embodiment shown in FIG. 9 is the most compact of all of the embodiments.

The sixth and final embodiment of an inertia switch according to the present invention is shown in cross-section in FIG. 10. In this embodiment, the electric contact mechanism again includes a lever and a pair of resilient electric contacts, and the biasing mechanism is integral with the lever and provides an adjustable biasing force.

Regarding the contact mechanism of the embodiment shown in FIG. 10, a lever 602 is again rotatably mounted to the switch body 600 by a pin 606. The lever 602 is disposed over the actuating shaft 30 portion of the inertia sensing pendulum 11. In this regard, the tip of the actuator shaft 30 is fitted into a socket 652 depending downwardly from the lever 602. The lever 602 is biased downwardly toward the inertia pendulum 11 by the biasing mechanism 620 attached between the lever 602 and the switch body 600.

The biasing mechanism includes a flat coil spring 622 having an inner end and outer end, with the inner end of the spring 622 being attached to the lever member 602, and with the outer end of the spring 622 being attached by an adjusting screw 624 to the switch body 600. The adjusting screw 624 is threaded into the switch body 600 and connects with the outer end of the coil spring 622 by a integral nut 626 attached thereto. Accordingly, rotation of the adjusting screw 624 moves the nut 626 in a horizontal disposition relative to the switch body 600. This movement controls the biasing force of the coil spring 622 upon the lever 602 and, accordingly, establishes the level of momentum change necessary to allow sufficient upward movement of the actuator shaft 30 to interrupt the electrical connection between the electric contacts in the switch body 600.

Regarding the resilient electrical contacts in the contact mechanism, the contacts are again a pair of thin, elongated, members 610 and 614 of electrically conductive material which are attached to the body 600. The first of these members 610 is mounted in fixed disposition within the housing body 600 and has a generally curved shape therein. The second conducting member 614 is mounted adjacent to the first conducting member 610. The resiliency of the second conducting member 614 urges it away from the first conducting member 610 in absence of an external force pressing it against the conducting member 610. The upper end 643 of the second conducting member 614 is generally L-shaped and is oriented adjacent to the free end 642 of the lever 602. As in the prior embodiments, the lever 602 moves between a first position and a second position, with the first position establishing an electrical connection between the first and second conducting members, and with the second position breaking the established electrical connection.

The generally curved shape of the second conducting member abuttingly engages the free end 642 of the lever 602 prior to a momentum change past the established level on the switch body 600. When this momentum change occurs, the upward movement of the actuator shaft 30 against the lever 602 moves the lever end 642 toward the upper end 643 of the second conducting member and thereby allows the second conducting member to move away from the first conducting member 610. The end 642 of the lever 602 rests upon the L-shaped upper end 643 of the second conducting member 614 after the second conducting member 614 has moved away from the first conducting member 610.

The lever 602 remains in this disposition until a external force is applied to it to move the lever downwardly away from the upper end 642 of the second conducting member 614. In this regard, a reset mechanism similar to that previously described for the other embodiments is provided. The reset mechanism includes a reset plunger 636 mounted to the body 600 for a slidable movement between a first position and a second position. The plunger 636 includes a plunger surface 637 disposed interiorly within the body and a plunger handle 640 exterior to the body. A spring bias 638 urges the plunger outwardly relative to the body. When manual pressure is applied to the plunger handle 640, the plunger surface 637 is brought in contact with the lever 602 and the lever 602 is moved downwardly, thereby repositioning the lever 602 in its initial position.

As with the other embodiments, the embodiment shown in FIG. 10 may include provisions allowing its use with an inversion detecting mechanism incorporated within of the switch body 600. Such a mechanism would be very similar to those previously described for the other embodiments.

In the foregoing description of the present invention, a preferred embodiment and several alternative embodiments of the invention have been disclosed. It is to be understood that other mechanical and design variations are within the scope of the present invention. Thus, by way of example and not of limitation, the reset mechanism could be disposed differently on the housing body; the mass used to detect inversion of the switch body could have various shapes and could contact a different portion of the switch mechanism; the biasing mechanism could use more than one spring member and could be oriented differently to urge the levers toward the inertia pendulum; the elongated members providing the electrical contact could be shaped differently; the lever members could be supported differently in the switch body to break an electrical connection upon the appropriate momentum change or body inversion; and the electrically conductive members could be positioned to create an electrical connection upon inversion of the body or when the body is subjected to a momentum change beyond a predetermined level, as opposed to breaking an electrical connection upon occurrence of such events. Accordingly, the invention is not limited to the particular arrangement which have been illustrated and described in detail herein.

What is claimed is:

1. An inertia switch having a switch body, comprising:

(a) inertia sensing pendulum means, mounted to said body, for detecting momentum changes of said body said pendulum means comprising:

(1) a generally hollow and cylindrical tiltable mass;

(2) actuator shaft means, passing centrally through said tiltable mass and moveable linearly upward relative to said mass; and (3) cam means, disposed within said pendulum means, for moving said shaft means linearly upward when a change in momentum of said switch body causes movement of said mass relative to said shaft means;

(b) electrical switch means including a pair of resilient elements establishing an electrical contact, attached to said body and contacting said shaft means, for resettably interrupting said electrical contact upon said upward movement of said shaft means; and (c) electrical contact biasing means, disposed between said body and said contact means, for preventing said shaft means from interrupting said electrical contact unless said change in momentum exceeds a predetermined level.

2. An inertia switch as defined in claim 1, wherein said switch further comprises:

reset means operably engaging said switch means, for reestablishing said interrupted electrical contact, said reset means including:

(a) a plunger slidably mounted in said body for movement against said switch means upon application of manual pressure upon said plunger, thereby reestablishing said electrical contact; and (b) plunger biasing means for biasing said plunger away from said switch means until said manual pressure is applied to said plunger, whereupon said plunger is moved against said switch means.

3. An inertia switch as defined in claim 2, wherein said switch means comprises:

a first elongated resilient member of electrically conductive material disposed interiorly within said body;

a second elongated resilient member of electrically conductive material disposed adjacent to said first member, said resilience of said second member urging said second member away from said first member;

lever means, journaled to said body for rotative movement between a first position and a second position, said first position urging said second member against said first member to establish an electrical contact, and said second position allowing said resilience of said second member to position said second member away from said first member to interrupt electrical contact and to prevent said lever means from returning to said first position, with said electrical contact biasing means biasing said lever in said first position until said upward movement of said shaft means, whereupon said lever means moves to and stays in said second position until said reset means returns said lever means to said first position.

4. An inertial switch as defined in claim 3, wherein said electrical contact biasing means comprises:

coil spring means, having an inner end and an outer end, with said inner end connected to said lever means, for urging said lever means downwardly against said shaft means; and adjusting screw means, connected to said outer end of said coil spring means, for tensioning said spring means, said tensioning determining the degree to which said coil spring means urges said lever means downwardly against said shaft means.

5. An inertia switch as defined in claim 2, wherein said switch further comprises:

a moveable spheroidal mass; and cylindrical cavity means, containing said spheroidal mass and coupled to said switch means, for guiding said mass to interrupt said electrical contact in response to an inversion of said body, whereby said electrical contact is interrupted when said predetermined level of momentum change is exceeded when said body is upright and when said body is inverted.

6. An inertia switch as defined in claim 5, wherein said switch means comprises:

lever means, journaled to said body for rotative movement between a first position and a second position, said biasing means urging said lever means toward said first position until occurrence of said upward movement of said shaft means or until occurrence of said contact between said spheroidal mass and said lever means, whereupon said lever means moves to said second position;

a pair of resilient conducting means, disposed within said body, for establishing an electrical contact when said lever means is in said first position, and for interrupting said electrical contact when said lever means is in said second position; and control arm means, integral with said conducting means and operatively engaging said lever means and said reset means, for positioning said conducting means to establish said electrical contact when said lever means is in said first position and to interrupt said contact when said lever means is in said second position, and for maintaining said lever means in said second position after said upward movement of said shaft means or said contact with said mass until said reset means reestablishes said contact.

7. An inertia switch as defined in claim 6 wherein said lever means further comprises lever stop means for limiting said rotative movement of said lever means upon said upward movement of said shaft means and said contact with said mass; and detent means, extending outwardly from said lever means, for abuttingly engaging said conducting means when said lever means is in said first position.

8. An inertia switch as defined in claim 6, wherein said conducting means comprises:

a pair of elongated resilient members of electrically conductive material passing through said body and having free ends disposed interiorly within said body and defining a pair of spaced contacts, the resilience of said members positioning said members apart when said lever means is in said second position.

9. An inertia switch as defined in claim 8, wherein said conducting means further comprises:

a pair of control arms diverging outwardly from one of said electrically conductive members, with one of said control arms abuttingly engaging said lever means in a manner causing contact between said conductive members when said lever means is in said first position, and maintaining said lever means in said second position upon occurrence of said upward movement of said shaft means or upon occurrence of said contact between said lever means with said spheroidal mass, and with said second control arm operatively engaging said reset means, when said reset means is activated, to move said first control arm to a position allowing said lever means to return to said first position, whereupon electrical contact is reestablished between said electrically conductive members.

10. An inertia switch as defined in claim 6, wherein said electrical contact biasing means comprises:

spring means, connected between said body and said lever means, for biasing said lever means against said upward movement of said shaft means, said biasing being small in comparison to the force on said lever means provided by said mass when said body is inverted, thereby allowing said lever means to be rapidly positioned to said second position when said body is inverted.

11. An inertia switch as defined in claim 6, wherein said electrical contact biasing means further comprises:

an adjusting platform slidably mounted to said cylindrical cavity means and connected between said spring means and said body; and adjusting means, extending through said body and into said platform, for moving said platform along said cylindrical means and thereby changing the biasing provided by said spring means on said lever means.

12. An inertia switch as defined in claim 6, wherein:

said cylindrical cavity means comprises a first cylindrical cavity angularly disposed beneath said pendulum means, and a second cavity disposed above said first cavity, with said mass being disposed in said first cavity; and said switch means further comprises an auxiliary lever disposed in said second cavity and journaled for rotative movement towards said shaft means upon contact with said mass; and an actuating rod disposed in said body between said lever means and said auxiliary lever, said actuating rod transferring said movement of said auxiliary lever to said lever means upon inversion of said body.

13. An inertia switch as defined in claim 5, wherein said switch means comprises:

an electrical switch module, mounted within said body and having a switching element depressably moveable between a position breaking an electrical contact and a position causing an electrical contact, with said contact position occurring when said switching element is depressed; and lever means, journaled to said body for rotative movement between a first position and a second position, said lever means including a lever end depressing said switching element to said contact position when said lever means is in said first position, with said biasing means biasing said lever means in said first position until occurrence of said upward movement of said shaft means, whereupon said shaft means moves said lever means to said second position, thereby allowing said switching element to move from said depressed position to break said electrical contact, said electrical contact remaining broken until said reset means is activated.

14. An inertia switch as defined in claim 13, wherein said electrical contact biasing means comprises:

spring means, connected between said body and said lever means, for biasing said lever means against said upward movement of said shaft means, said biasing being small in comparison to the force on said lever means provided by said spheroidal mass when said body is inverted, thereby allowing said lever means to be rapidly positioned to said second position when said body is inverted.

15. An inertia switch as defined in claim 13, wherein said lever means comprises:

a first lever rotatably attached to said body above and in contact with said shaft means and engaging said biasing means; and a second lever rotatably attached to said body adjacent said first lever, said second lever including a first flange member disposed over said first lever in abutting relation and including a substantially concave lever end engaging said switching element, whereby said upward movement of said shaft means against said first lever is transferred by said flange to said second lever and causes said concave end to disengage said switching element, whereupon said electrical contact is broken.

16. An inertia switch as defined in claim 15, wherein said switch means further comprises:

spheroidal mass means for detecting inversion of said switch body; and a second flange member disposed on said second lever adjacent said mass means, whereby said inversion of said switch body causes said spheroidal mass means to contact said second flange member, thereby rotating said concave end away from said switching element and breaking said electrical contact.

17. An inertia switch having a switch body, comprising (a) inertia sensing pendulum means, mounted to said body, for detecting momentum changes of said body, said pendulum means comprising:

(1) a generally hollow and cylindrical tiltable mass;

(2) actuator shaft means, passing centrally through said tiltable mass and moveable linearly upward relative to said mass; and (3) cam means, disposed within said pendulum means, for moving said shaft means linearly upward when a change in momentum of said switch body causes said movement of said mass relative to said shaft means;

(b) electrical switch including a pair of resilient elements establishing an electrical contact, attached to said body and contacting said shaft means, for resettably interrupting said electrical contact upon said upward movement of said shaft means;

(c) electrical contact biasing means, disposed between said body and said switch means, for preventing said shaft means from interrupting said electrical contact unless said change in momentum exceeds a predetermined level;

(d) reset means, operably engaging said switch means, for reestablishing said interrupted electrical contact, said reset means including:

(1) a plunger slidably mounted said body for movement against switch means upon the application of manual pressure upon said plunger, thereby reestablishing said electrical contact; and (2) plunger biasing means for biasing said plunger away from said switch means until said manual pressure is applied to said plunger, whereupon said plunger is moved against said switch means;

(e) a moveable spheroidal mass;

(f) cylindrical cavity means, containing said spheroidal mass and coupled to said contact means, for guiding said mass to said switch means to interrupt said electrical contact in response to an inversion of said switch body, whereby said electrical contact is interrupted when said body is inverted and when said predetermined level of momentum change is exceeded when said body is upright, said cylindrical cavity means being disposed beneath said shaft means with said spheroidal mass urging said shaft means upwardly when said body is inverted; and (g) said switch means comprising a first curved resilient member of electrically conductive material disposed above said shaft means, said first member being biased by said electrical contact biasing means against the interior of said body to snap between an upward curvilinear disposition and a downward curvilinear disposition; and a second member of electrically conductive material adjacent said first member and contacting said first member when said first member is in said downward disposition, with first said first member being oriented in said downward disposition until said upward movement of said shaft means, whereupon said first member snaps to said upward disposition and breaks said electrical contact with said second member until said reset means repositions said first member in said downward disposition.

18. An inertia switch as defined in claim 6, wherein said electrical contact biasing means comprises:

a generally cylindrical opening in said body;

a piston member disposed in said opening immediately adjacent said first member;

a spring member disposed in said opening adjacent said piston member; and adjusting means, adjacent said spring member, for urging said spring member against said piston, said piston transferring said biasing force of said spring member against said first conductive member, thereby biasing said member in said curvilinear dispositions, with the degree of curvature being determined by the depth of said adjusting screw in said cylindrical opening.

19. An inertia switch having a switch body comprising:

(a) electric switch contact means, disposed within said body in non-contacting relation, for establishing an interruptable electrical contact when urged into contacting relation, said contact means comprising a pair of elongated resilient members of electrically conductive material passing through said body and having free ends disposed interiorly within said body and defining a pair spaced contacts, said resilience of said members positioning said contacts apart unless said lever means urges said members into contacting relation, whereupon said electrical contact is established;

(b) lever means, journalled to said body, for maintaining said contact means in contacting relation to establish said electrical contact, said lever means comprising a lever member journalled to said body for rotative movement between a first position at which said contact means is maintained in contacting relation, and a second position at which said contact means is in noncontacting relation;

(c) inertia sensing pendulum means, positioned within said body and in abutting relation with said lever member, for moving said lever member to said second position upon a momentum change of said switch body above a predetermined level, thereby interrupting said electrical contact;

(d) biasing means, connected between said lever member and said switch body; for urging said lever member against said pendulum means and toward said first position, thereby determining said level of momentum above which said inertia sensing pendulum means moves said lever member to said second position to interrupt said electrical contact;

(e) reset means, manually positionable against said contact means, to reposition said contact means in contacting relation to reestablish said interrupted electrical contact, said repositioning of said contact means allowing said biasing means to move said lever member to said first position to maintain said contact means in contacting relation to maintain said electrical contact;

(f) a moveable mass;

(g) cylindrical cavity means, containing said mass, for guiding said mass to contact said lever member in response to an inversion of said body, whereby said electrical contact is interrupted when said body is inverted or when said predetermined level of momentum is exceeded when said body is upright; and (h) said contact means further comprising:

a pair of control arms diverging outwardly from one of said conductive members, with one of said control arms abuttingly engaging said lever member to cause contact between said conductive members when said lever member is in said first position, and to maintain said lever member in said second position when said predetermined level of momentum has been exceeded and upon contact between said mass and said lever member, and with said second control arm positioned to engage reset means upon manual activation thereof to move said one of said conductive members to a position allowing said lever member to return to said first position, whereupon electrical contact is reestablished between said electrically conductive members, with the first of said control arms maintaining said conductive members in contacting relation.

20. An inertia switch having a switch body comprising:

(a) electrical switch contact means, disposed within said body and noncontacting relation, for establishing an interruptable electrical contact when positioned in contacting relation, said contact means comprising a pair of elongated resilient members of electrically conductive material passing through said body and having free ends disposed interiorly within said body to define a pair of spaced contacts, said resilience of said members positioning said contacts apart unless said members are urged into contacting relation, whereupon said electrical contact is established;

(b) lever means, journalled to said body, for maintaining said members in contacting relation to establish said electrical contact;

(c) inertia sensing pendulum means, in abutting engagement with said lever means, for moving said lever means to a position, upon a momentum change of said body above a predetermined level, to allow the resilience of said conductive members to position said members in noncontacting relation to innterrupt said electrical contact, said interia sensing pendulum means comprising:

(1) a tiltable mass including a pendulum body including a lightweight apertured base of cup-like configuration and having an interorly formed actuator camming surface means, a hollow cylindrical inertia sensing mass of a material relatively heavier than said base, and means for securely attaching said mass to said base with said hollow mass and said apertured base providing a vertical axial bore therethrough; and (2) actuator shaft means, disposed in said axial bore of said pendulum body and including a thrust flange intermediate its upper and lower ends, with said flange being contained within said pendulum body and normally resting on said actuator camming surface means and with said upper end extending outwardly of said mass, whereby a change in momentum on said body causes movement of said pendulum body relative to said actuator shaft means, with said actuator shaft means being moved vertically upward to said lever means by engagement between said thrust flange and said camming surface means (d) biasing means, coupling said lever means to said switch body, for determining said level of momentum above which said actuator shaft means moves said lever means upwardly to allow the resilience of said conductive members to position said contacts apart to interrupt said electrical contact;

(e) reset means, coupled to said conductive members, for reestablishing said interrupted electrical contact upon the application of manual pressure to said reset means;

(f) a moveable mass; and (g) cylindrical cavity means, containing said mass and operatively engaging said lever means, for guiding said mass to contact said lever means in response to an inversion of said body, whereby said electrical contact is selectively interrupted when said body is inverted or when said predetermined level of momentum is exceeded when said body is upright.

21. An inertia switch as defined in claim 20, wherein said biasing means comprises:

spring means, connected between said body and said lever means, for biasing said lever means against said upward movement of said actuator shaft means, with said biasing being small in comparison to the force on said lever means provided by said mass when said body is inverted, thereby allowing said lever means to be rapidly positioned to an orientation allowing said contact means to assume a noncontacting relation and interrupting said electrical contact.

22. An inertia switch having a switch body and a pair of switch contacts within said body forming an interruptable electrical contact:

(a) tiltable mass means, mounted to said body, for detecting momentum changes of said body above a predetermined level;

(b) vertically moveable actuator means, associated with said tiltable mass means, for producing an upward movement when said momentum level has been exceeded;

(c) lever arm means, operably engaging said actuator means and said switch contacts, for resettably interrupting said electrical contact upon said upward movement said actuator means;

(d) biasing means, engaging said lever means, for determining said predetermined level of momentum;

(e) reset means, coupled to said lever means, for reestablishing said interrupted electrical contact;

(f) a moveable mass;

(g) cylindrical cavity means, containing said mass and coupled to said lever arm means, for guiding said mass to contact said lever arm means in response to an inversion of said body, whereby said lever arm means selectively interrupts said electrical contact when said body is inverted and when said predetermined level of momentum change is exceeded when said body is upright;

(h) said lever means comprising a lever member, journaled to said body for rotative movement between a first position and a second position, with said biasing means urging said lever member toward said first position until occurrence of said upward movement of said actuator means or until occurrence of said contact between said mass and said lever member, whereupon said lever member moves to said second position; and (i) said switch contacts comprising:

(1) a pair of elongated resilient members of electrically conductive material passing through said body and having free ends disposed interiorly within said body and defining a pair of spaced contacts, said resilience of said members positioning said contacts apart when said lever member is in said second position, and said members establishing an electrical contact when said lever member is in said first position; and (2) control arm means, integral with one of said conductive members and operatively engaging said lever member and said reset means, for positioning said conductive members to establish said electrical contact when said lever member is in said first position and to interrupt said contact when said lever member is in said second position, and for maintaining said lever member in said second position after said upward movement of said actuator means or said contact with said mass until said reset means reestablishes said contact.

23. An inertia switch as defined in claim 22, wherein said control arm means comprises:

a pair of contact arms diverging outwardly from one of said electrically conductive members, with one of said control arms abuttingly engaging said lever member in a manner causing contact between said conductive members when said lever member is in said first position, and maintaining said lever member in said second position upon occurrence of said upward movement of said actuator means or upon occurrence of said contact between said lever member and said mass, and with said second control arm operatively engaging said reset means, when said reset means is activated, to move said first control arm to a position allowing said lever member to return to said first position, whereupon electrical contact is reestablished between said electrically conductive members.

24. An inertia switch having a switch body and a pair of switch contacts within said body forming an interruptable electrical contact, comprising:

(a) tiltable mass means, mounted to said body, for detecting momentum changes of said body above a predetermined level;

(b) vertically moveable actuator means, associated with said tiltable mass means, for producing an upward movement when said momentum level has been exceeded;

(c) lever arm means, operably engaging said actuator means and said switch contacts, for resettably interrupting said electrical contact upon said upward movement of said actuator means;

(d) said tiltable mass means comprising a pendulum body including a lightweight apertured base of cup-like configuration having an interiorly formed actuator camming surface means, a hollow cylindrical inertial sensing mass of a material relatively heavier than said base and means for securing said mass to said base with said hollow mass and said apertured base providing a vertical axial bore therethrough; and (e) said vertically movable actuator means comprising actuator shaft means, disposed in said axial bore of said pendulum body and including a thrust flange intermediate its upper and lower ends, with said flange being contained with said pendulum body and normally resting on said actuator camming surface means and with said upper end extending outwardly of said mass, whereby a momentum change greater than said predetermined level moves said pendulum body relative to said actuator shaft means, said actuator shaft means thereupon being moved upwardly against said lever arm means by engagement between said thrust flange and said camming surface means, with said upward movement causing said lever arm means to interrupt said electrical contact.

* * * * *